United States Patent [19]

Tupper

[11] Patent Number: 4,459,916

[45] Date of Patent: Jul. 17, 1984

[54] LOAD-TRANSFER SYSTEM

[76] Inventor: Alan W. Tupper, The Weavers House, Castle Combe, Wiltshire, SN14 7HX, England

[21] Appl. No.: 360,985

[22] Filed: Mar. 23, 1982

[30] Foreign Application Priority Data

Apr. 16, 1981 [GB] United Kingdom ..... 8112106

[51] Int. Cl.[3] ..... F01B 25/22; B61B 12/02

[52] U.S. Cl. ..... 104/106; 16/96 R; 104/182; 105/151

[58] Field of Search ..... 104/106, 112, 182, 185, 104/186, 198, 199, 89, 93, 107, 109, 110, 111; 105/148, 150, 151; 191/76; 16/96 R

[56] References Cited

U.S. PATENT DOCUMENTS

| | | | |
|---|---|---|---|
| 364,669 | 6/1887 | Prentice | 104/182 |
| 506,037 | 10/1893 | Forbes | 104/182 |
| 878,653 | 2/1908 | Matthews et al. | 104/182 X |
| 904,119 | 11/1908 | Downs | 104/182 |
| 1,106,471 | 8/1914 | Opsal | 104/182 |
| 1,122,024 | 12/1914 | O'Connell | 104/182 |
| 1,429,007 | 9/1922 | Wilson | 104/182 |
| 1,501,748 | 7/1924 | Chapman et al. | 104/182 |
| 3,922,972 | 12/1975 | Junes | 105/153 |
| 4,265,179 | 5/1981 | Tupper et al. | 104/182 |

FOREIGN PATENT DOCUMENTS

| | | | |
|---|---|---|---|
| 2049592 | 12/1980 | United Kingdom | 104/182 |

*Primary Examiner*—Randolph Reese

*Attorney, Agent, or Firm*—Scully, Scott, Murphy & Presser

[57] ABSTRACT

A track is provided by a series of rigid or semi-rigid members supported solely or principally at their ends to extend across the track at spaced locations along the track. A load-transfer device is provided to engage with the track for movement along the track. The device comprises at least one rotary wheel having several equally spaced recesses provided in its periphery and a guide member mounted on the wheel, the wheel and guide member having cooperating relatively rotatable surfaces to allow rotation of the wheel relative to the guide member. The rigid or semi-rigid members are received in respective recesses in the wheel when the device moves along the track and the wheel rotates relative to the guide member to allow such members to pass through the device with at least one of those members being located with respect to the wheel by the guide member at any one time.

4 Claims, 8 Drawing Figures

LOAD-TRANSFER SYSTEM

FIELD AND BACKGROUND OF THE INVENTION

This invention relates to a system for enabling a load to be moved along a specific elongate path or paths and/or over a specific area or areas.

My British Patent No. 1,582,201 and corresponding U.S. Pat. No. 4,265,179 disclose a load-transfer device for moving a load along a track defined by an elongate element, such as a wire or rope or a rod or a tubular member, past support points therefor. The present invention provides a development of this system.

SUMMARY OF THE INVENTION

According to the invention there is provided a system comprising a track defined by a series of rigid or semi-rigid members supported solely or principally at the edges of the track to extend across the track at spaced locations along the track and a load-transfer device for engagement with and movement along the track, the device comprising at least one rotatable wheel which is formed with several recesses in its periphery and the recesses being evenly spaced around the wheel with adjacent recesses being separated by a projecting part of the wheels a guide member supported on the wheel, the guide member and the wheel having cooperating relatively rotatable surfaces and the arrangement being such that, when the device and any one of said rigid or semi-rigid members, encounter one another, said wheel can rotate about its axis relative to the guide member with said rigid or semi-rigid member being received, guided and passed in one of the aforesaid recesses with at least one of said rigid or semi-rigid members being located with respect to the wheel by the guide member at any one time while the member is engaged with the track and moved therealong.

In some systems according to the invention, the track may be elongate comprising straight and/or curved sections. In such arrangements with width of the track may be narrow relative to its length so that it has the form of a ladder. At least some of the sections of the track may comprise a spaced series of said rigid or semi-rigid members joined at their ends by rigid support means extending along the length of the track. At least some of the sections of the track may comprise a spaced series of said rigid or semi-rigid members joined at their ends by support means, the configuration of which can be altered, e.g. to take up either straight and/or curved and/or other configurations as required, and in some arrangements may be used to connect rigid straight sections, for example by curved sections. Such support means may comprise articulated links as in a bicycle chain.

In other systems according to the invention, the track may be provided by a generally planar member having a series of elongate slots therein which extend along the length of the track to leave a series of spaced transverse bars therebetween to act as rigid or semi-rigid members of the track.

The track therefore may be narrow and elongate for locating a member for movement along a specific path, e.g. along deck portions of a yacht or along portions of the rigging, for providing attachment tracks around the deck or the rigging to which a lanyard hook of a life jacket can be attached to allow free movement about the deck as described in my British Patent Specification No. 2,024,749 and U.S. Pat. No. 4,313,236 or for locating edge portions of the sails as described in my British Patent Application No. 2,060,532 and corresponding U.S. Pat. Application No. 250,719 filed on Apr. 3, 1981 now U.S. Pat No. 4,357,889. Other systems according to the invention can be used for materials handling, e.g. for suspending or locating loads as described in my British Patent Specification No. 2,049,592 and corresponding U.S. Pat. Application Ser. No. 135,443 filed March 31, 1980, now U.S. Pat. No. 4,352,330. One or more elongate tracks of a system according to the present invention may be used to lead into a mesh suspended over a work area as described in my British Patent Specification No. 2,049,592.

The track of a system according to the present invention may be relatively wide in relation to its length and may be mounted overhead thereby allowing loads to be suspended therefrom and to move not only along the track but also laterally thereof by sliding the load suspended from a load-transfer device engaged with the track, along the lengths of the transverse rigid or semi-rigid members of the track. One possible application of this system may be a display apparatus for articles of clothing which are hung from the overhead track. The clothing can be located in a general line along one side of the track so that individual articles can be inspected by moving the load-transfer device to which it is attached laterally of the track and out of the general line of the articles of clothing. One or more narrow tracks may extend into the wider track section for permitting movement to or from specific locations remote from the wider track section.

One or more of said rigid or semi-rigid members may be omitted from the track at specific engagement points allowing a load-transfer device to be plugged into the system at any such point.

The rigid or semi-rigid members may be joined by longitudinal side frame members as described above, or a system according to the invention could be set up by inserting transverse bars or rods or other rigid or semi-rigid members in an existing structure e.g. by locating their ends in beams or other structural members of an existing building to support a wide track over a floor area for goods handling.

In constructions according to the invention the guide member and said wheel may have interengaging male and female connecting portions. Preferably such portions can comprise an arcuate flange on the guide member which engages in corresponding grooves formed in the, or respective, wheel to permit rotation of the wheel(s) about its axis relative to the guide member. In some constructions according to the invention, a pair of spaced wheels may be provided, the wheels being mounted coaxially and each wheel having projecting parts as aforesaid defining said recesses and the guide member having two arcuate flange means engaging in respective corresponding grooves formed in the confronting surfaces of both wheels thereby to retain the guide member in the space between the wheel while allowing rotation of the wheels relative to the guide member. My British Patent Specification No. 1,582,201 and my British Patent Application No. 8112221, and U.S. Pat. Application Ser. No. 360,986 (AWT 12), filed on the same day as this present application describe load-transfer devices which may be used in systems according to the invention. The devices described in my British Patent Application No. 8112221 comprise at least one rotary wheel which is formed with several recesses in its periphery, the recesses being evenly spaced around the wheel with adjacent recesses being separated by a projecting part of the wheel; a guide member supported on the wheel, said guide member and said wheel having cooperating relatively rotatable surfaces and the arrangement being such that, when the device and a load bearing element, which extends transversely to the plane of said one wheel and cooperates in use with the device, encounter one another, said one wheel can rotate about its axis relative to the guide member with said element being received, guided and passed in one or a succession of the aforesaid recesses with said element, or an elongate member supported thereby, being located with respect to the wheel by the guide member; and a connection element for attachment of a load or a load support to the device, the connection element being pivotally mounted on the wheel about the axis thereof and there being provided interengaging plug and socket portions between the connection element and an adjacent face of said wheel.

In some constructions according to the invention the load-transfer device may comprise a single wheel having arcuate grooves formed in the opposite side surfaces of the projecting parts of the wheel with each series of grooves lying on a circle centred on the axis of rotation of the wheel, and the guide member may have arcuate flanges engaged in the recesses, respectively to allow rotation of the wheel with respect to the guide member. The guide member may be provided with means for engaging and riding across the surface of the track which in use is remote from a load attached to the load-transfer device. Such engaging means may comprise means which are adapted to slide over said remote surface of the track, for example a ski device for bridging a number of the rigid or semi-rigid members of the track.

DETAILED DESCRIPTION

Figure 1:
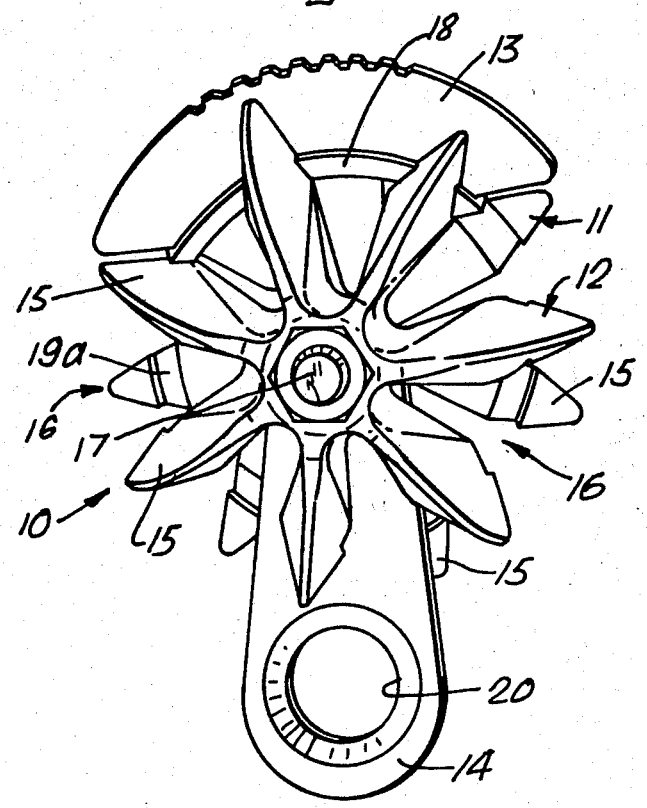
FIG. 1 is a perspective view of a load-transfer device for use in a system according to the invention.
Figure 2:
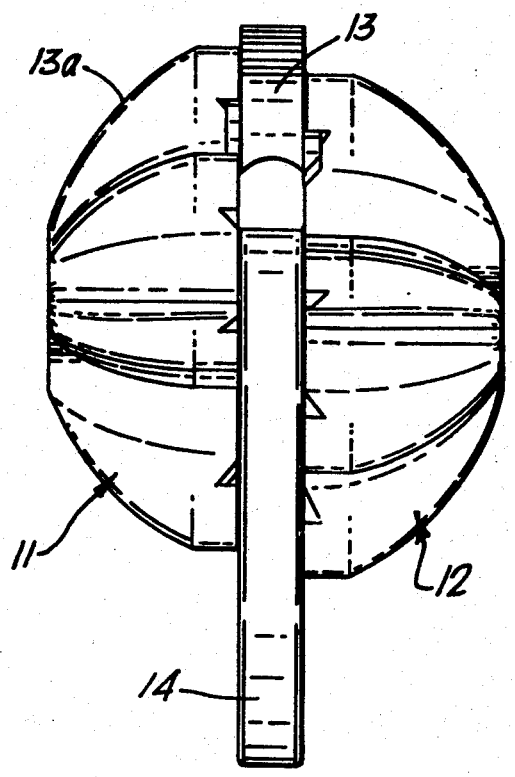
FIG. 2 is a side view of the device of FIG. 1.

Referring to FIGS. 1 and 2 of the drawings, a load-transfer device 10 for use in a system in accordance with the invention comprises two wheels 11 and 12, a guide member 13 and a load attachment member 14. As seen in FIG. 2, each wheel 11, 12 has a generally dome-shaped outer surface with a flat inner surface facing the similar surface on the other wheel. Referring again to FIG. 1, each wheel in this particular embodiment, has seven radially projecting portions 15 which define therebetween 7 equi-angularly spaced recesses 16. The wheels are rotatably mounted on axle 17 in a spaced apart relationship as seen in FIG. 2. The dome-shaped surfaces 13*a*, as seen in FIG. 2, comprise in this embodiment, a relatively flat central area joined by an angular curved section to an angular axually extending outer rim. However in other possible constructions the aforesaid central area need not necessarily be flat. The shape selected for the wheels will be such as to provide an integrated central area which provides a bulk of material at the location of the grooves in the wheels to accommodate loads imposed thereon in use which could otherwise cause fracture at such locations.

The guide member 13, positioned between the wheels at a peripheral part thereof, has a pair of axially projecting arcuate flanges 18 which engage in the correspondingly shaped grooves 19*a*, formed in the inner confronting surfaces of the projecting parts 15 of the wheels thereby to locate the guide member 13 in position between the wheels while allowing the wheels to rotate complete revolutions in either direction with respect to the guide member.

As seen in FIG. 1, the load-connecting element 14, which is in the form of a strip rounded at both ends and narrowing in width towards its upper end, has an aperture 20 at its lower end for connecting a load thereto and is pivotally mounted on the axle 17 at its upper end.

The components of the load-transfer device may be made of any suitable material, for example, a metal, such as stainless steel, or for lighter uses a plastic material may be used.

Figure 3:
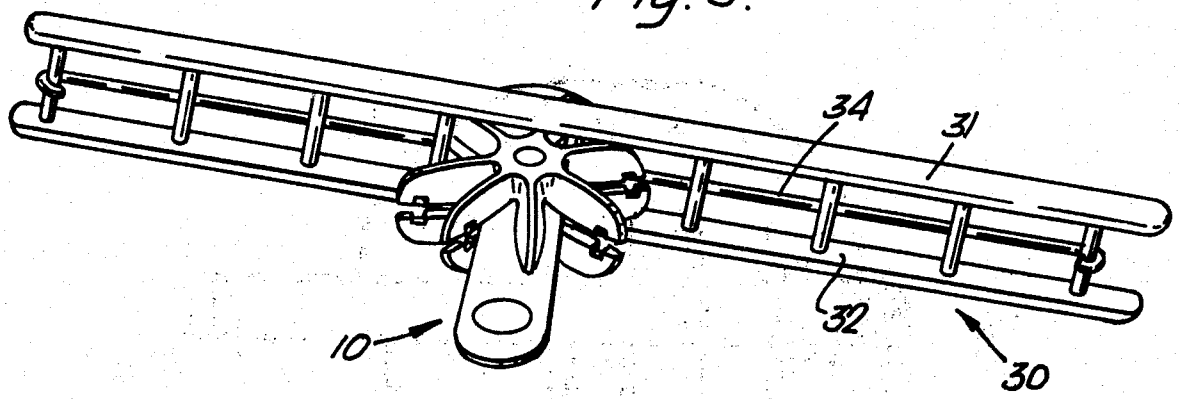
FIG. 3 is a perspective view of a straight track section and a load-transfer device as shown in FIG. 1 engaged therewith.

As shown in FIG. 3, the load-transfer device 10, which is similar in construction to the device shown in FIGS. 1 and 2 except that the two wheels have a flatter form, is engaged with a track which comprises one or more sections in the general form of a ladder. FIG. 3 shows a straight section 30 having a pair of spaced parallel side members 31, 32 and a series of transverse bars 33 joining the side members at spaced locations therealong. The load-transfer device 10 can be engaged with a track 30 at one end thereof, or one or more of the bars 33 could be removed from an intermediate portion of the track section in order to allow the device to be "plugged" therein for engagement with a track. The device 10 is engaged with a track by moving it longitudinally of the track so that the first bar 33 which is encountered, engages in a pair of corresponding recesses 16 in the wheels 11 and 12. On further movement of the device 10 along the track the wheels rotate relative to the guide member 13 so that as the respective bars 33 are passed through the device in respective recesses 16 of the wheels. The bars are located with respect to the device by the guide member 13. The bars 33 are spaced such that at any one time during movement of the device 10 along the track, at least one of the bars 33 is positively held in a pair of recesses 16 of the wheel by the guide member 13.

A further elongate element, e.g. a wire or a rod, may be positioned to extend longitudinally of the track centrally of the bars 33. The member 34, when provided extends between the wheels in sliding engagement with the guide member 13. Indeed a similar elongate member may cooperate with the track section 30 so that a device 10 can be moved along a path or paths defined by the "ladder" type track section(s) as well as sections provided by a rigid or flexible elongate member such as a wire rod or tube. However, it will be appreciated that the load-transfer device can be engaged and run along track sections of the "ladder" type without the elongate member 34 provided therealong.

Figure 4:
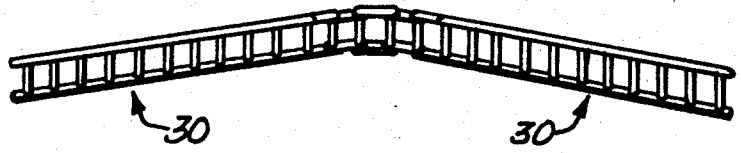
FIGS. 4 and 5 are diagrammatic representations of track sections for use in systems according to the invention.
Figure 5:
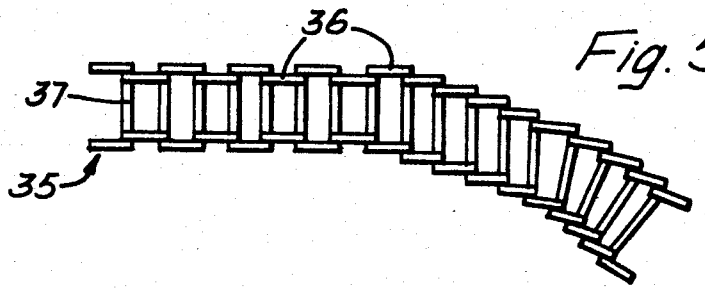

FIG. 4 illustrates a track defined by two rigid straight sections 30 joined by a curved section 35 provided by a track section of the type shown in FIG. 5 which can be adjusted to various desired configurations. The track section 35 comprises a series of articulated rigid links 36, the joints of which are provided by the transverse cylindrical bars 37 providing a construction somewhat akin to a bicycle chain. This track 35 can be formed to include step-down and fan-shaped sections, (in the latter case by using different length links at the top and bottom of the track as shown in FIG. 5) as required. With such a section, which can be used in conjunction with the straight section shown in FIG. 3, a variety of differently shaped paths can be constructed. The transverse bars of the "ladder" track shown in FIGS. 3 to 5 may be curved or bowed downwardly when the track is to support a suspended load. In this case a load likely to swing from side to side during transport can move freely along the track, which would not be the case if straight bars are provided.

A track constructed of sections as shown in FIGS. 3–5 could be located along the edge of a deck of a yacht to provide an attachment point for the free end of a lanyard of a life jacket to provide an alternative system to that described in my British Patent Specification No. 2,024,749 and corresponding U.S. Pat. No. 4,313,236. Alternatively the track could be used to guide the edge portion of a sail and could be mounted either on a portion of the deck or as a portion of a mast or boom as described in my British Patent Specification No. 2,060,532 and corresponding U.S. Pat. No. 4,357,889.

Figure 6:
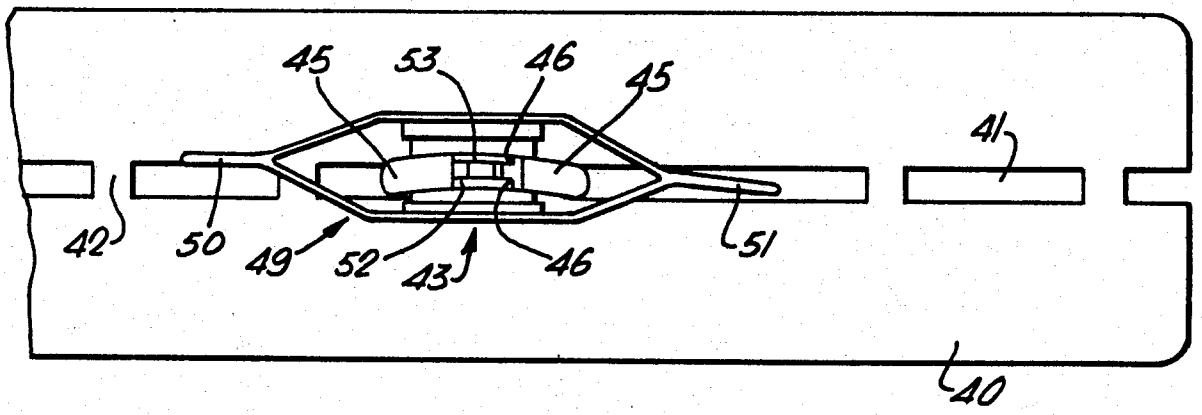
FIGS. 6 and 7 show respectively a planned view and an underplan view of a further system embodying the invention; and, FIG. 8 is a diagrammatic perspective view of a yet further system embodying the invention.
Figure 7:
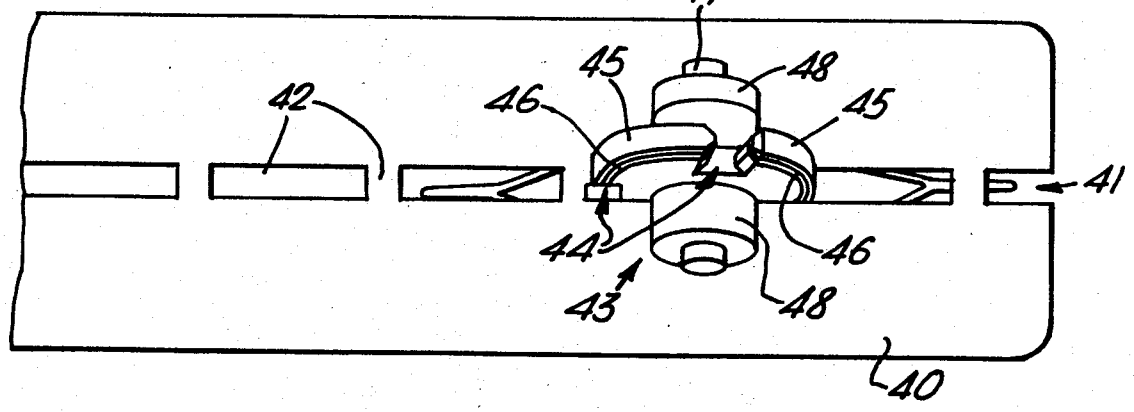

Another possible form of track is shown in FIGS. 6 and 7. The track is provided by a generally planar strip of material 40 in which a series of elongate slots 41 are formed leaving a series of transverse bars 42 between the slots. In this arrangement the load-transfer device 43 comprises a single wheel in which three equi-angularly spaced recesses 44 are provided leaving 3 projecting parts 45 of the wheel, which have part cylindrical outer peripheries. In each face of the projecting parts 45 an arcuate recess 46 is formed. In this embodiment the wheel is mounted on an axle 47 having on either side of the wheel a pair of rollers 48 for running along a surface of the track 40. The guide member is in the form of a ski device 49 comprising two strips which extend on either sides of the wheel, the strips converging to meet at corresponding ends thereof to provide a pair of pointed end sections 50, 51. The central portions of the strips of the ski device are provided with a pair of arcuate flanges 52, 53 which engage in the recesses on opposite sides of the wheel, respectively. As the device 43 moves along the track the bars 42 are received in the recesses 44 in the wheel which, on further movement of the device along the track, rotates relative to the ski device 49 to allow the bars 42 to pass through the device, which is maintained in engagement with the track by the guide member 49.

This type of track could be provided along longitudinal side edges of a conveyor belt with a series of load-transfer devices 43 engaged therewith and suspended from above such slotted edging strips e.g. by means of an A-frame suspension having yoke members having arms embracing the devices 43 and being secured to the axles 47 thereof. The slotted edging strips may be flexible so that this system can be applied to endless belt systems. Such conveyor belt suspension systems eliminate the need for rollers supporting the belt.

Figure 8:
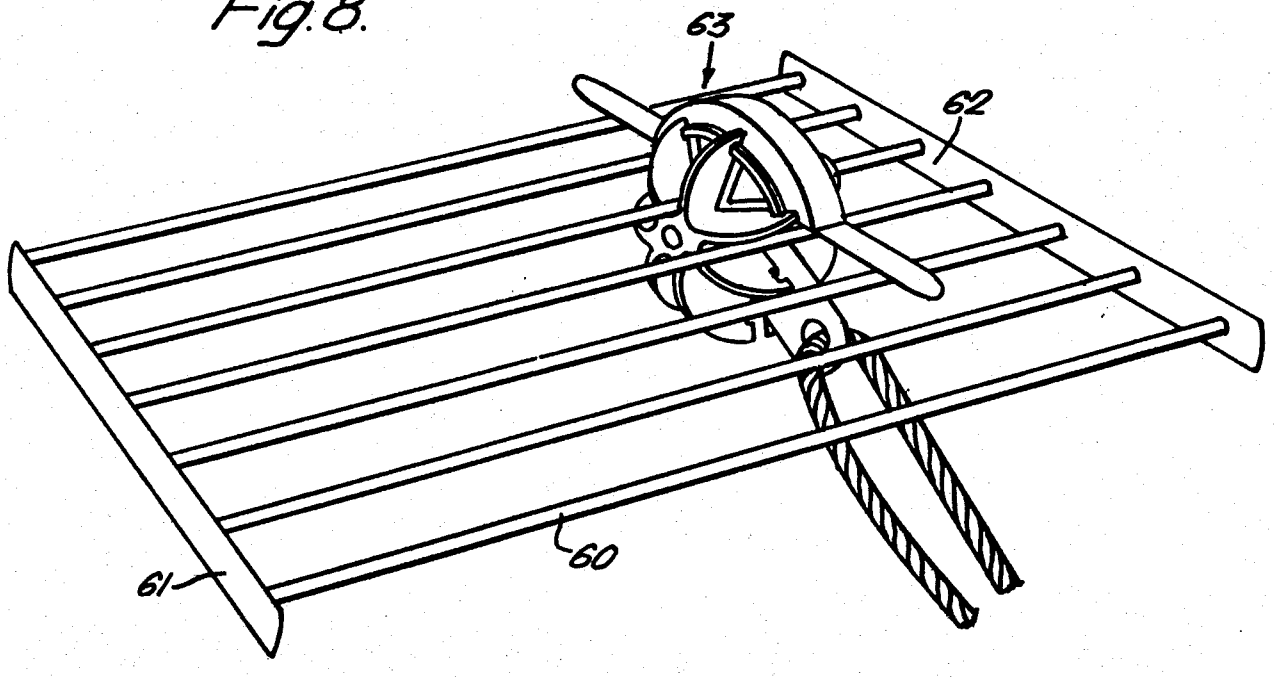

FIG. 8 shows a further construction according to the invention in which the track, which is provided by a series of transverse rods 60 mounted at their ends in side strips 61, 62 is relatively wide with respect to the load-transfer device 63. This construction allows movement of a load not only along the track but also laterally of the track by sliding the load-transfer device 63 in longitudinal directions of the bar 60. This track can be used in conjunction with one or more "ladder" type tracks and/or with elongate elements in the form of wires, rods, or tubes, extending outwardly from its periphery to specific remote locations. In other similar embodiments the guide member of the device 63 may be provided with a ski-type sliding member similar to that used for the device of FIGS. 6 and 7. Furthermore a load-transfer device as shown in any of the Figures of my British Patent Specification No. 2049592 and corresponding U.S. Pat. No. 4,352,330 could be used including the device shown in FIG. 6 thereof which includes a clamping device for clamping the load-transfer device at any desired position.

In any of the above embodiment except that of FIGS. 6 and 7 hereof, the transverse bars of the track may be provided by rods which are mounted to be freely rotatable in order to assist in reducing friction.

The disclosures in my British Patent No. 1,582,201; U.S. Pat. No. 4,265,179; British Patent Specification No. 2,024,749; U.S. Pat. No. 4,313,236; British Patent Application No. 2,060,532; U.S. Pat. No. 4,357,889; British Patent Specification No. 2,049,592; U.S. Pat. No. 4,352,330; British Patent Application 8112221; U.S. Pat. Application No. 360,986 (Ref: AWT 12) filed on the same day as the present application, are all included herein by reference.

What I claim is:

1. A system comprising a track defined by a series of rigid or semi-rigid members supported solely or principally at a pair of opposite edges of the track to extend across the track at spaced locations along the track and a load-transfer device for engagement with and movement along the track, the device comprising a rotatable wheel which is formed with several recesses in its periphery and the recesses being evenly spaced around the wheel with adjacent recesses being separated by a projecting part of the wheel; a guide member supported on the wheel, the guide member and said projecting parts of the wheel having cooperating relatively rotatable surfaces whereby, when the device and any one of said rigid or semi-rigid members, encounter one another, said wheel can rotate about its axis relative to the guide member with said rigid or semi-rigid member being received, guided and passed in one of the aforesaid recesses with at least one of said rigid or semi-rigid members being located with respect to the wheel by the guide member at any one time while the member is engaged with the track and moved therealong, wherein the track is provided by a generally planar member having a series of elongate slots therein which extend along the length of the track to leave a series of spaced transverse bars therebetween to act as the rigid or semi-rigid members of the track.

2. A system according to claim 1, wherein the guide member is provided with means for engaging and riding across the surface of the track which in use is remote from a load attached to the load-transfer device.

3. A system according to claim 2 wherein such engaging means comprise means which are adapted to slide over said remote surface of the track.

4. A system according to claim 3 wherein said means adapted to slide over said remote surface of the track comprise a ski device having pointed ends for bridging a number of the rigid or semi-rigid members of the track to slide thereover in use.

* * * * *